US009102189B2

(12) United States Patent
Chuang

(10) Patent No.: US 9,102,189 B2
(45) Date of Patent: Aug. 11, 2015

(54) ENGRAVING MACHINE

(71) Applicant: Bor-Yann Chuang, Taichung (TW)

(72) Inventor: Bor-Yann Chuang, Taichung (TW)

( * ) Notice: Subject to any disclaimer, the term of this patent is extended or adjusted under 35 U.S.C. 154(b) by 484 days.

(21) Appl. No.: 13/689,330

(22) Filed: Nov. 29, 2012

(65) Prior Publication Data

US 2014/0148937 A1 May 29, 2014

(51) Int. Cl.
*B44B 3/00* (2006.01)

(52) U.S. Cl.
CPC ..... *B44B 3/009* (2013.01)

(58) Field of Classification Search
CPC ..... B44B 3/009
See application file for complete search history.

(56) References Cited

U.S. PATENT DOCUMENTS

| | | | | | |
|---|---|---|---|---|---|
| 3,694,570 | A * | 9/1972 | Kotov et al. | 358/3.29 |
| 3,843,875 | A * | 10/1974 | Goodstal et al. | 700/160 |
| 3,915,061 | A * | 10/1975 | Stockman | 409/84 |
| 4,352,973 | A * | 10/1982 | Chase | 219/121.68 |
| 4,437,150 | A * | 3/1984 | Dahlgren et al. | 700/180 |
| 4,573,798 | A * | 3/1986 | Fujie et al. | 356/432 |
| 5,203,088 | A * | 4/1993 | Morgan | 33/21.1 |
| 5,293,426 | A * | 3/1994 | Wouch et al. | 358/3.29 |
| 5,569,003 | A * | 10/1996 | Goldman et al. | 409/132 |
| 5,663,801 | A * | 9/1997 | Hada et al. | 358/3.29 |
| 5,714,367 | A * | 2/1998 | Quick et al. | 428/195.1 |
| 5,719,683 | A * | 2/1998 | Yoshida | 358/3.29 |
| 6,180,913 | B1 * | 1/2001 | Kolmeder et al. | 219/121.68 |
| 2005/0038547 | A1 * | 2/2005 | Walthall | 700/118 |
| 2006/0242818 | A1 * | 11/2006 | Penick et al. | 29/560 |
| 2010/0087947 | A1 * | 4/2010 | Chuang | 700/164 |
| 2013/0249130 | A1 * | 9/2013 | Schneider et al. | 264/1.37 |

* cited by examiner

*Primary Examiner* — Ramesh Patel
(74) *Attorney, Agent, or Firm* — Ming Chow; Sinorica, LLC

(57) ABSTRACT

An engraving machine includes a machine base, an engraving device and a clamping device assembled on the machine base, and a control unit. The clamping device is able to clamp a work piece and actuate the work piece to rotate. The control unit is composed of a 3-D picture converter, a coordinate location definer and a positioning controller. By so designing, a datum is first converted into a 3-D picture by the 3-D picture converter and then, coordinate locations of the circumferential face of the work piece is defined by the coordinate location definer and lastly, a carving knife is driven and positioned by the control unit to carry out operation of engraving, lowering cost, convenient in operation and able to freely to change speed ratio between a driving mechanism and a driven mechanism.

8 Claims, 6 Drawing Sheets

ENGRAVING MACHINE

BACKGROUND OF THE INVENTION

1. Field of the Invention

This invention relates to an engraving machine, particularly to one able to carry out three-dimensional engraving.

2. Description of the Prior Art

A conventional engraving machine is mainly employed for carving letters, pictures and external forms in a work piece. For elevating precision in carving a work piece, the conventional engraving machine is connected with a computer and consists of a control system, which is composed of a control soft ware and a positioning controller. In using, Data are first input into the computer and then transmitted to the control system by transmission lines to be compiled and calculated by the control soft ware to produce control commands to be sent to the positioning controller for driving the three-dimensional engraving machine to carve the work piece into a finished product with a predetermined form.

However, for carrying out 3-D engraving, a control system with more than four axes has to be employed, thus increasing cost. In addition, for diversifying finished products, it is necessary to design various patterns for engraving, but it is complicated in designing patterns; hence only those who are professionally trained in drawing are capable of doing the job, resulting in increase of training cost. Further, work pieces are not of a uniform size so designs of 3-D figures have to be changed for tallying with the sizes of the work pieces, not only increasing extra cost but rendering a finished product lacking of fidelity as well, and furthermore it is extremely difficult in operation of the control system so it has to increase cost for training such operators. Therefore, it is certainly essential how to research and develop an engraving machine that is low in cost and convenient in operation.

SUMMARY OF THE INVENTION

The objective of this invention is to offer an engraving machine that is low in cost, convenient in operation and able to freely change speed ratio.

The engraving machine in the present invention includes a machine base, an engraving device, a clamping device and a control unit. The engraving device is assembled on the machine base, composed of a carving knife, a first traveling unit and a second traveling unit. The first traveling unit can drive the carving knife to move in a direction parallel to the horizontal surface of the machine base, while the second traveling unit can drive the carving knife to move in a direction perpendicular to the horizontal surface of the machine base.

The clamping device is positioned on the machine base, able to clamp a work piece and having one end connected with a rotary unit to enable the clamping device to actuate the work piece to rotate.

The control unit is electrically connected with both the engraving device and the rotary unit, consisting of a 3-D picture converter, a coordinate location definer and a positioning controller. The 3-D picture converter functions to have a datum converted into a 3-D picture; the coordinate location definer is able to have the outer circumferential face spread out to be a plane surface and the positioning controller able to drive and position the first traveling unit and the second traveling unit and the rotary unit. The control unit further contains an electronic cam.

The engraving machine of this invention is to have the datum converted into the 3-D picture via the 3-D picture converter and then, have the coordinates of the plane surface defined by the coordinate location definer. When reading the 3-D picture, the control unit will automatically converted the 3-D picture into a shifting distance of both the first traveling unit and the second traveling unit and into a rotation angle of the rotary unit and then, the speed ratio of the first traveling unit and the second traveling unit and the rotary unit will be changed by the electronic cam. Lastly, the control unit will drive and position the carving knife to carry out carving work. To sum up, the engraving machine of this invention is low in cost, convenient in operation and able to freely change speed ratio.

BRIEF DESCRIPTION OF DRAWINGS

This invention will be better understood by referring to the accompanying drawing, wherein.

DETAILED DESCRIPTION OF THE PREFERRED EMBODIMENT

Figure 1:
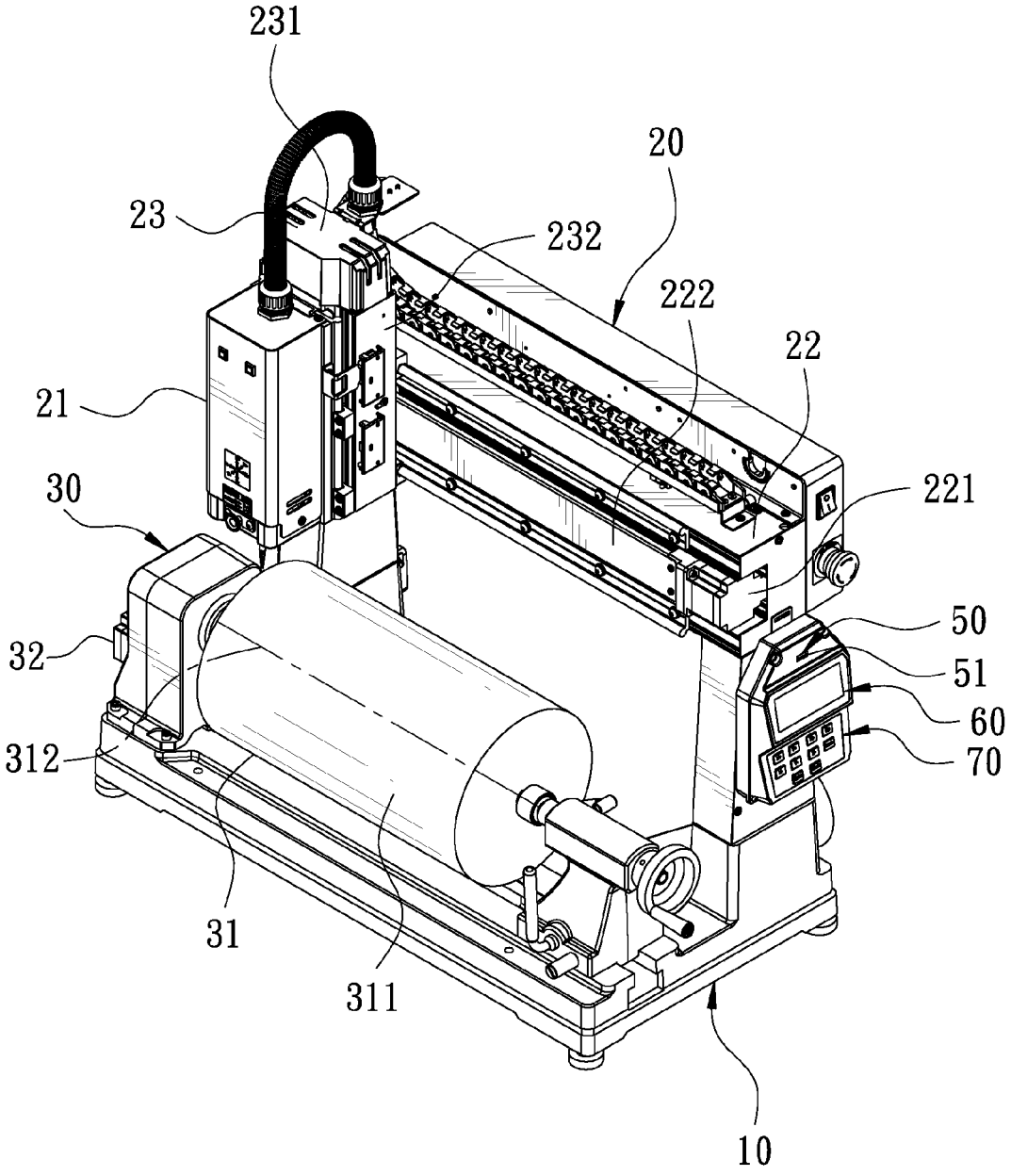
FIG. 1 is a perspective view of an engraving machine in the present invention.
Figure 2:
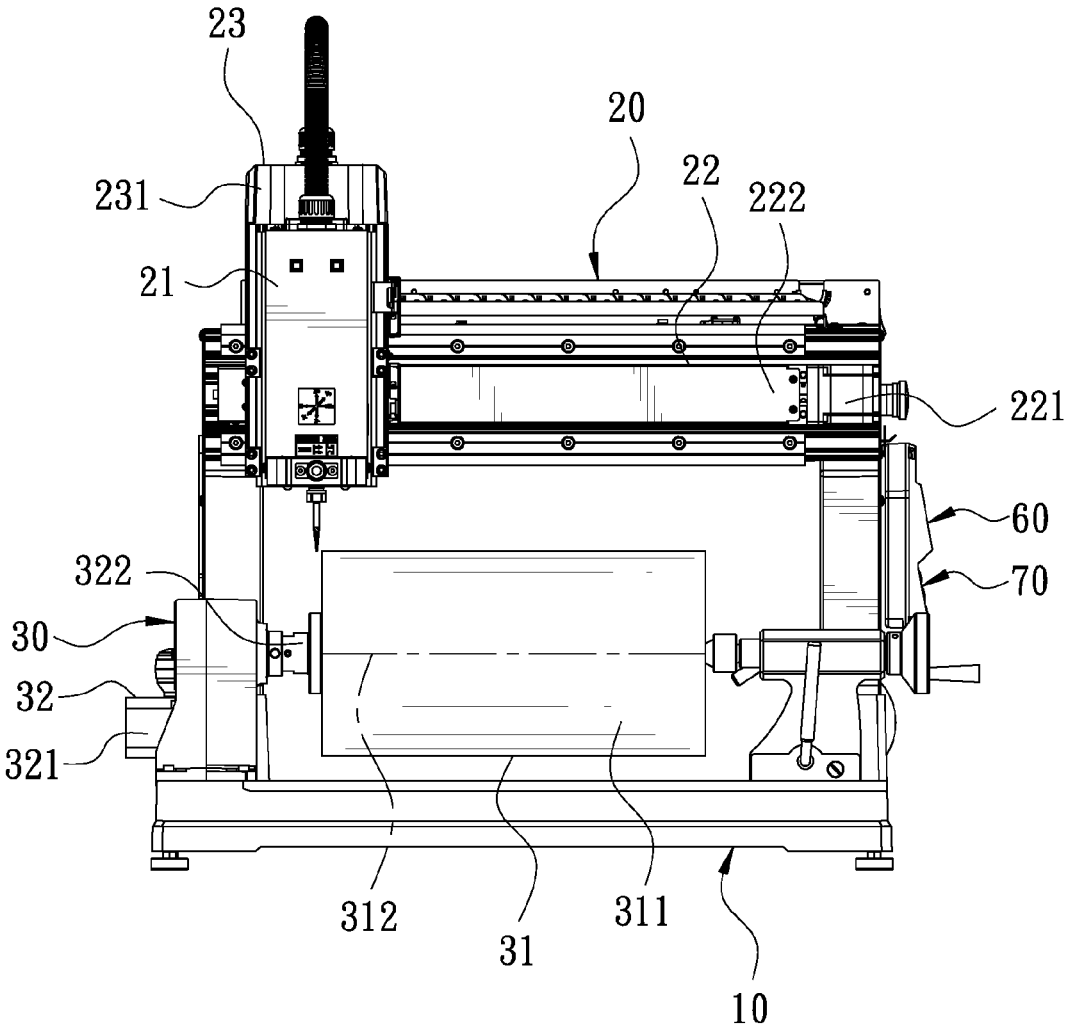
FIG. 2 is a side cross-sectional view of the engraving machine in the present invention.
Figure 3:
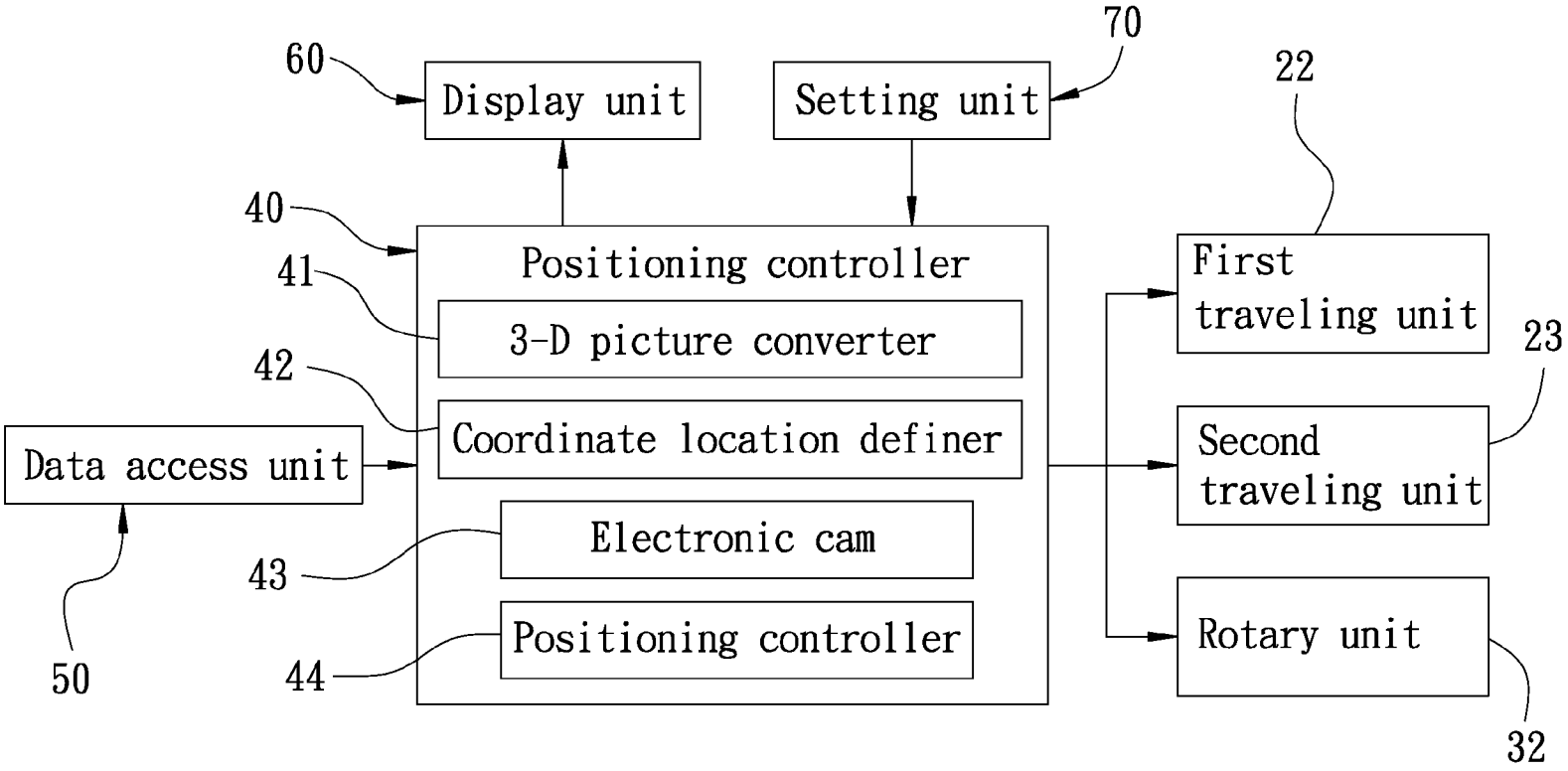
FIG. 3 is a block diagram of a control system of the engraving machine in the present invention.

A preferred embodiment of an engraving machine in the present invention, as shown in FIGS. 1-3, includes a machine base 10, an engraving device 20, a clamping device 30, a control unit 40, a data access unit 50, a display unit 60 and a setting unit 70 as main components combined together.

The carving device 20 mounted on the machine base 10 is composed of a carving knife 21, a first traveling unit 22 and a second traveling unit 23. The first traveling unit 22 can function to drive the carving knife 21 to shift in a direction parallel to the horizontal surface of the machine base 10, while the second traveling unit 23 can actuate the carving knife 21 to move in a direction perpendicular to the horizontal surface of the machine base 10. The first traveling unit 22 consists of a first driving mechanism 221 and a first driven mechanism 222, while the second traveling unit 23 contains a second driving mechanism 231 and a second driven mechanism 232.

The clamping device 30 is positioned on the machine base 10 for clamping a columnar work piece 31 that is formed at least with an outer circumferential face 311 and a center shaft 312, the work piece 31 being cylinder-shaped in this preferred embodiment. The clamping device 30 has one end connected with a rotary unit 32 so as to enable the clamping device 30 to drive the work piece to rotate. The rotary unit 32 is composed of a third driving mechanism 321 and a third driven mechanism 322, able to drive the work piece 31 to rotate around the center shaft 312. The first traveling unit 22 is able to drive the carving knife 21 to move in a direction parallel to the center shaft 312, while the second traveling unit 23 able to drive the carving knife 21 to move in a direction parallel to the diameter of the work piece 31.

The control unit 40 is electrically connected with both the engraving device 20 and the rotary unit 32, composed of a 3-D picture converter 41, a coordinate location definer 42, an electronic cam 43 and a positioning controller 44. The 3-D picture converter 41 can convert a datum 411 into a 3-D picture 412, the datum 411 being a plane picture in this preferred embodiment. The coordinate location definer 42 functions to have the outer circumferential face 311 of the work piece 31 spread out to be a plane surface 313 and define the coordinate locations of the plane surface 313. The positioning controller 44 can actuate and position the first traveling unit 22, the second traveling unit 23 and the rotary unit 32, while the electronic cam 43 is able to change the speed ratio between the driving mechanism and the driven mechanism.

The data access unit 50 electrically connected with the control unit 40 employs a universal serial bus (USB) to be an interface, and the machine base 10 has an outer casing provided with a USB plug socket 51 for accessing the datum 411.

The display unit 60 electrically connected with the control unit 40 is secured on the outer casing of the machine base 10 for showing information.

The setting unit 70 makes electrical connection with the control unit 40, positioned on the outer casing of the machine base 10 for setting and inputting commands and controlling the control unit 40.

Figure 4:
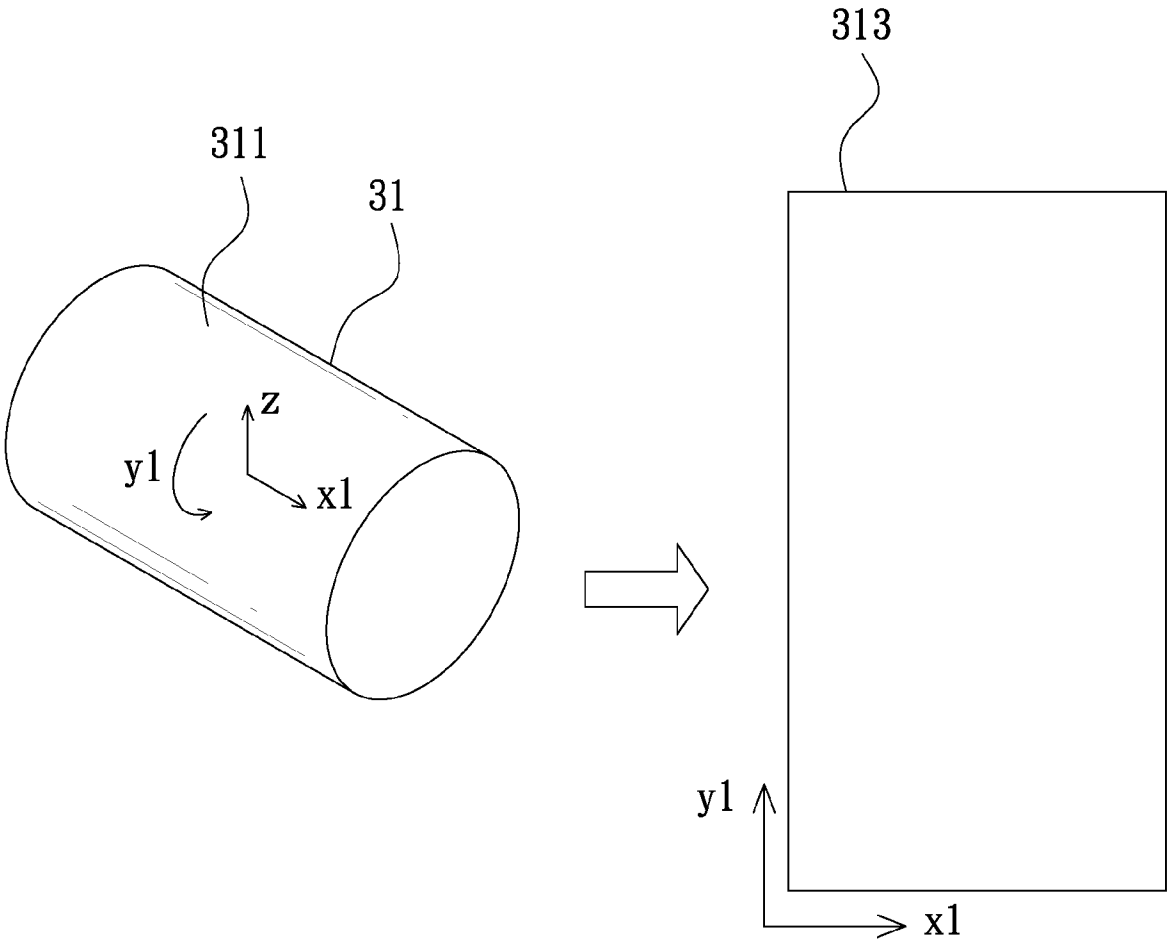
FIG. 4 is a schematic view illustrating that the circumferential face of a work piece is spread out to be a plane surface in the present invention.
Figure 5:
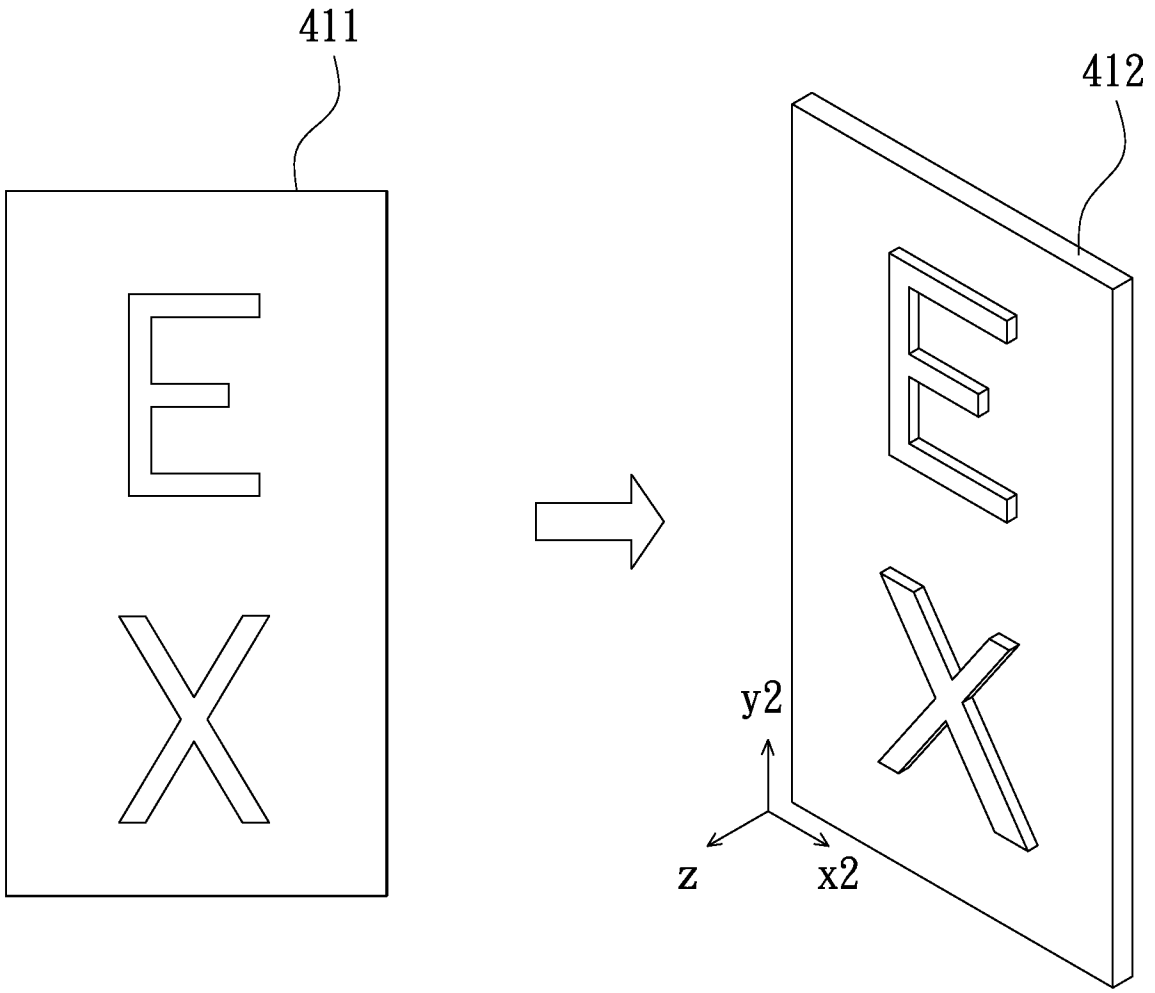
FIG. 5 is a schematic view illustrating that a plane picture is converted into a 3-D picture in the present invention.
Figure 6:
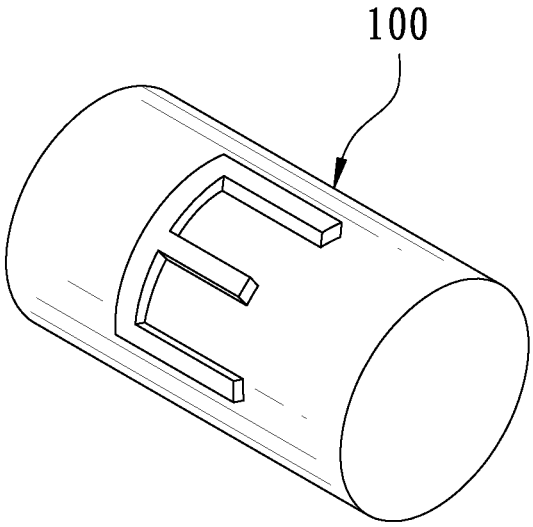
FIG. 6 is a schematic view of a carved product by the engraving machine of this invention.

To use the engraving machine, firstly, have the datum 411 stored in a USB flash disk 52 and then the USB flash disk 52 is plugged in the USB plug socket 51 to have the datum 411 transmitted to the control unit 40 via the data access unit 50 and have information shown on the display unit 60 so that a user can make use of the setting unit 70 to set and input commands for carrying out engraving. FIG. 4 shows that the work piece of this invention has an outer circumferential face spread out to be a plane surface. The coordinate location definer 42 functions to have the outer circumferential face 311 of the work piece 31 spread out to be a plane surface 313, and the horizontal direction and the vertical direction of the plane surface 313 are respectively defined to have an x1 coordinate value and a y1 coordinate value to enable the coordinates of the plane surface 313 to be defined by the x1 value and the y1 value. FIG. 5 shows that a plane picture is converted into a 3-D picture. The 3-D picture converter 41 functions to convert the datum 411 into the 3-D picture 412, which, relative to the plane surface 313, is defined to have an x2 coordinate value, a y2 coordinate value and a z coordinate value. Additionally, the electronic cam 43 can function to change the speed ratio of the first traveling unit 22, the second traveling unit 23 and the rotary unit 32. Lastly, the control unit 40 functions to drive and position the first traveling unit 22, the second traveling unit 23 and the rotary unit 32 for drive the carving knife 21 to carve the 3-D picture 412 in the plane surface 313 to complete a finished product 100, as shown FIG. 6.

In the present invention, the coordinates of the plane surface 313 is defined by the coordinate location definer 42; therefore, when the control unit 40 reads the x2 coordinate value and the y2 coordinate value, the control unit 40 will have the carving knife 21 positioned to the relative x1 coordinate value and y1 coordinate value of the plane surface 313 and then drive the carving knife 121 to do 3-D carving of z coordinate value. When reading the x2 coordinate value and the z coordinate value, the control unit 40 can automatically convert the x2 value and the z value into a shifting distance of the first traveling unit 22 and of the second traveling unit 23 and when reading the y2 coordinate value, the control unit 40 can automatically convert the y2 value into a rotation angle of the rotary unit 32 and then, the first traveling unit 22, the second traveling unit 23 and the rotary unit 32 will be driven and positioned by the positioning controller 44.

In the present invention, the datum 411 is converted into the 3-D picture 412 through the 3-D picture converter 41. The datum 411 can be selected from the pictures drawn by drawing soft ware or from the pictures captured by an image-recording device, simple and convenient in design, and the operation of engraving is controlled by the setting unit 70 and the control unit 40, easy and convenient in operation.

In the present invention, the speed ratio of the first traveling unit 22 and the second traveling unit 23 and the rotary unit 32 can be changed by the electronic cam 43. In this preferred embodiment, when the positioning controller 44 reads the x2 coordinate value, the y2 coordinate value and the z coordinate value, the electronic cam 43 will change the rotation angles of the driving mechanism by a certain proportion and further change the speed ratio between the driving mechanism and the driven mechanism and thus, the restriction of hardware speed ratio between the driving mechanism and the driven mechanism can be changed by the electronic cam 43, able to change the speed ratio freely.

While the preferred embodiment of the invention has been described above, it will be recognized and understood that various modifications may be made therein and the appended claims are intended to cover all such modifications that may fall within the spirit and scope of the invention.

What is claimed is:

1. An engraving machine comprising:

a machine base;

an engraving device assembled on said machine base, said engraving device composed of a carving knife, a first traveling unit and a second traveling unit, said first traveling unit able to actuate said carving knife to shift in a direction parallel to a horizontal plane of said machine base, said second traveling unit functioning to drive said carving knife to move in a direction perpendicular to the horizontal plane of said machine base;

a clamping device mounted on said machine base, said clamping device employed to clamp a work piece, said clamping device having one end connected with a rotary unit to enable said clamping device to drive said work piece to rotate; and a control unit electrically connected with both said engraving device and said rotary unit, said control unit composed of a 3-D picture converter, a coordinate location definer and a positioning controller, said 3-D picture converter able to convert a datum into a 3-D picture, said coordinate location definer able to have an outer circumferential face of said work piece spread out to be a plane surface and define coordinate locations of said plane surface, said positioning controller functioning to drive and position said first traveling unit and said second traveling unit and said rotary unit;

and said control unit able to control said carving knife to carry out engraving of said work piece and obtain a finished product in accordance with said 3-D picture.

2. The engraving machine as claimed in claim 1, wherein a data access unit is electrically connected with said control unit, said data access unit employing universal serial bus (USB) to be an interface and said machine base having an outer casing provided with a USB plug socket for accessing data.

3. The engraving machine as claimed in claim 1, wherein a display unit makes electrical connection with said control unit, said display unit provided on an outer casing of said machine base for showing information.

4. The engraving machine as claimed in claim 1, wherein a setting unit is electrically connected with said control unit, said setting unit fixed on the outer casing of said machine base for setting and inputting commands and controlling said control unit.

5. The engraving machine as claimed in claim 1, wherein said control unit further contains an electronic cam, and said first traveling unit and said second traveling unit and said rotary unit are respectively disposed with a driving mechanism and a driven mechanism, said electronic cam able to change speed ratio between said driving mechanism and said driven mechanism.

6. The engraving machine as claimed in claim 1, wherein said work piece is column-shaped.

7. The engraving machine as claimed in claim 1, wherein said work piece is formed with a center shaft, and said first traveling unit can actuate said carving knife to move in a direction parallel to said center shaft, said second traveling unit able to drive said carving knife to move in a direction parallel to a diameter of said work piece, said rotary unit functioning to drive said work piece to rotate with said center shaft acting as an axis.

8. The engraving machine as claimed in claim 1, wherein said datum is a plane picture.

* * * * *